US008094082B2

(12) United States Patent
Rudant et al.

(10) Patent No.: US 8,094,082 B2
(45) Date of Patent: Jan. 10, 2012

(54) POLARIZATION DIVERSITY MULTI-ANTENNA SYSTEM

(75) Inventors: Lionel Rudant, Grenoble (FR); Christophe Delaveaud, Saint Jean de Moirans (FR)

(73) Assignee: Commissariat a l'Energie Atomique, Paris (FR)

( * ) Notice: Subject to any disclaimer, the term of this patent is extended or adjusted under 35 U.S.C. 154(b) by 349 days.

(21) Appl. No.: 12/439,750

(22) PCT Filed: Sep. 3, 2007

(86) PCT No.: PCT/EP2007/059197

§ 371 (c)(1),
(2), (4) Date: Mar. 6, 2009

(87) PCT Pub. No.: WO2008/028892

PCT Pub. Date: Mar. 13, 2008

(65) Prior Publication Data

US 2009/0273528 A1 Nov. 5, 2009

(30) Foreign Application Priority Data

Sep. 4, 2006 (FR) ..... 06 53562

(51) Int. Cl.
*H01Q 21/24* (2006.01)

(52) U.S. Cl. ..... 343/725; 343/700 MS; 343/767

(58) Field of Classification Search ..... 343/700 MS, 343/725, 727, 767, 846
See application file for complete search history.

(56) References Cited

U.S. PATENT DOCUMENTS

| | | | | |
|---|---|---|---|---|
| 4,893,126 | A * | 1/1990 | Evans | 342/175 |
| 5,241,321 | A * | 8/1993 | Tsao | 343/700 MS |
| 5,977,874 | A * | 11/1999 | Konstandelos | 340/554 |
| 6,424,300 | B1 | 7/2002 | Sanford et al. | |
| 7,109,921 | B2 * | 9/2006 | Leelaratne | 343/700 MS |
| 2004/0021605 | A1 | 2/2004 | Kouam et al. | |

FOREIGN PATENT DOCUMENTS

| | | | |
|---|---|---|---|
| EP | 1 225 654 | A1 | 7/2002 |
| EP | 1 401 050 | A1 | 3/2004 |
| WO | 98/37593 | A1 | 8/1998 |
| WO | 2004/102744 | A1 | 11/2004 |
| WO | 2007/028448 | A1 | 3/2007 |

OTHER PUBLICATIONS

Michishita et al; "A polarization diversity antenna by printed dipole and a patch with a hole", published in Proc. of IEEE Antennas and Propagation Society International Symposium, vol. No. 3, May 2001, pp. 368-371.

Kuga et al; "A patch-slot composite antenna for VH-polarization diversity base stations", published in Proc. of Asia-Pacific Microwave Conference, Dec. 2000.

Garg et al; "Expressions for wavelength and impedance of a slotline" published in the IEEE Trans. on Microwave Theory, Aug. 1976, p. 532.

International Search Report for PCT/EP2007/059197.

* cited by examiner

*Primary Examiner* — Tho G Phan
(74) *Attorney, Agent, or Firm* — Pearne & Gordon LLP

(57) ABSTRACT

The invention relates to a polarization diversity multi-antenna system comprising a first slot type antenna (20) and at least one second patch type antenna (30), said first and second antennas sharing the same ground plane (10), the slot of the first antenna being laid out in said ground plane and the patch of the second antenna being at least partly plumb with said slot.

10 Claims, 10 Drawing Sheets

- - - - - Vertical polarization – Patch type antenna
– – – Vertical polarization – Patch type antenna
—■— Vertical polarization – Slot type antenna
—■— Horizontal polarization – Slot type antenna

POLARIZATION DIVERSITY MULTI-ANTENNA SYSTEM

TECHNICAL FIELD

The present invention relates to the field of antennas, notably that of polarization diversity antennas for telecommunications terminals.

STATE OF THE PRIOR ART

Among the many steps for improving the signal-to-noise ratio in a mobile telecommunication system, resorting to transmission and/or reception diversity techniques is known. At the base station, antennas sufficiently distant from each other (by a distance larger than at least the half wavelength at the operating frequency) may for example be used, a network of antennas for forming beams pointing in distinct angular directions or antennas transmitting according to distinct polarizations may be used: depending on the case this is termed as spatial diversity, angular diversity or polarization diversity. Similarly, the same diversity techniques are in principle applicable to the mobile terminal. Either antennas sufficiently distant from each other will be used so that the received signals have been subject to non-correlated conditions of propagation, antennas having reception diagrams pointing in distinct angular directions or further antennas with distinct polarizations, for example according to linear polarizations orthogonal to each other, will be used.

Unfortunately, mobile terminals poorly lend themselves to the application of diversity techniques. Indeed, the small dimensions of the mobile terminals do not generally allow sufficient separation of the receiving antennas at the currently used operating frequencies (80 MHz-6 GHz). As a result, the signals received by the different antennas are correlated because of neighbouring conditions of propagation or because of coupling between antennas. The signals received may then have simultaneous fading and the mobile terminal does not fully benefit from the advantages of diversity.

A polarization diversity multi-antenna system for a mobile terminal was proposed in the article of N. Michishita et al. entitled <<A polarization diversity antenna by printed dipole and a patch with a hole>> published in Proc. of IEEE Antennas and Propagation Society International Symposium, Vol. No. 3, May 2001, pages 368-371. This system consists of a patch antenna and of a dipole antenna. The patch is perforated with a hole through which the dipole antenna printed on a substrate passes. This system is not planar and does not easily lend itself to integration into a mobile terminal.

A polarization diversity multi-antenna system for a base station was proposed in the article of N. Kuga et al. entitled <<A patch-slot composite antenna for VH-polarization diversity base stations>> published in Proc. of Asia-Pacific Microwave Conference, December 2000. It comprises two networks of interleaved antennas: a first network consisting of patch type elements with horizontal polarization and a second network consisting of patch type elements with vertical polarization. The elements of the first network are excited by slots cut out in the ground plane whereas the elements of the second network are excited by microstrip lines. Neither is this multi-antenna system compatible with integration into a mobile terminal.

The object of the present invention is to find a remedy to the aforementioned drawbacks, i.e. to propose a compact diversity multi-antenna system which may easily be integrated into a mobile terminal while only having low coupling between antennas.

DISCUSSION OF THE INVENTION

The present invention is defined by a polarization diversity multi-antenna system comprising a first slot type antenna and a second patch type antenna, said first and second antennas sharing the same ground plane, the slot of the first antenna being laid out in said ground plane and the patch of the second antenna being at least partly plumb with said slot, said first and second antennas having a common operating frequency band, wherein:

said slot is open on one side over its width and its length is substantially equal to an odd multiple of the quarter of the guided wavelength in the slot in said operating frequency band and/or the patch is electrically connected to the ground plane and its length is substantially equal to an odd multiple of the quarter of the guided wavelength in the patch at said operating frequency band.

Particular embodiments of the invention are defined in the dependent claims.

SHORT DESCRIPTION OF THE DRAWINGS

Other features and advantages of the invention will become apparent upon reading a description of a preferential embodiment of the invention, made with reference to the appended figures wherein:

FIG. 1 schematically illustrates a multi-antenna system according to a first embodiment of the invention;

FIG. 2 schematically illustrates a multi-antenna system according to a second embodiment of the invention;

FIG. 3 schematically illustrates a multi-antenna system according to a third embodiment of the invention;

FIG. 4 schematically illustrates a multi-antenna system according to a fourth embodiment of the invention;

FIG. 5 schematically illustrates a multi-antenna system according to a fifth embodiment of the invention;

FIG. 6 schematically illustrates a multi-antenna system according to a sixth embodiment of the invention;

FIG. 7 schematically illustrates a multi-antenna system according to a seventh embodiment of the invention;

DETAILED DISCUSSION OF PARTICULAR EMBODIMENTS

The idea at the basis of the invention consists of associating on a same ground plane, a patch type antenna and a slot type antenna, the patch being at least partly plumb with the slot. The geometry and the orientation of the patch and of the slot are selected so that the patch type antenna and the slot type antenna may each transmit and/or receive according to a rectilinear polarization, the polarization directions associated with both antennas being orthogonal to each other. In a receiving mode, the signals received by the patch antenna and the slot antenna respectively, may be combined in order to provide reception diversity.

More specifically, the geometry and the orientation of the patch and the slot are selected so that the respective directions of established resonance in the patch and in the slot are substantially parallel. Conventionally, it is known that for a patch the distribution of the electric field along the direction of established resonance is sinusoidal and has two maxima at each end of the patch. Similarly, for a slot, the distribution of electric field along the direction of established resonance is sinusoidal and has two nulls at each end of the slot. In one case as in the other, the number of periods of the sinusoidal distribution depends on the order of the resonance. The electromagnetic field generated by the patch is conventionally denoted $TM_{n0}$ where n gives the order of the resonance along the resonance direction x, the electric field being directed along this direction. Likewise, the electromagnetic field generated by the slot is conventionally denoted $TE_{n'}$ where n' gives the order of the resonance along the resonance direction x', the electric field being orthogonal to x' and parallel to the plane of the slot.

Surprisingly, it was seen that co-localization of the slot type antenna and of the patch type antenna according to the invention did not significantly change the characteristics of both antennas taken separately. In particular, the coupling level between the antennas is remarkably low. Further, impedance matching may be achieved independently for both of the antennas in a common operating frequency band.

Figure 1:
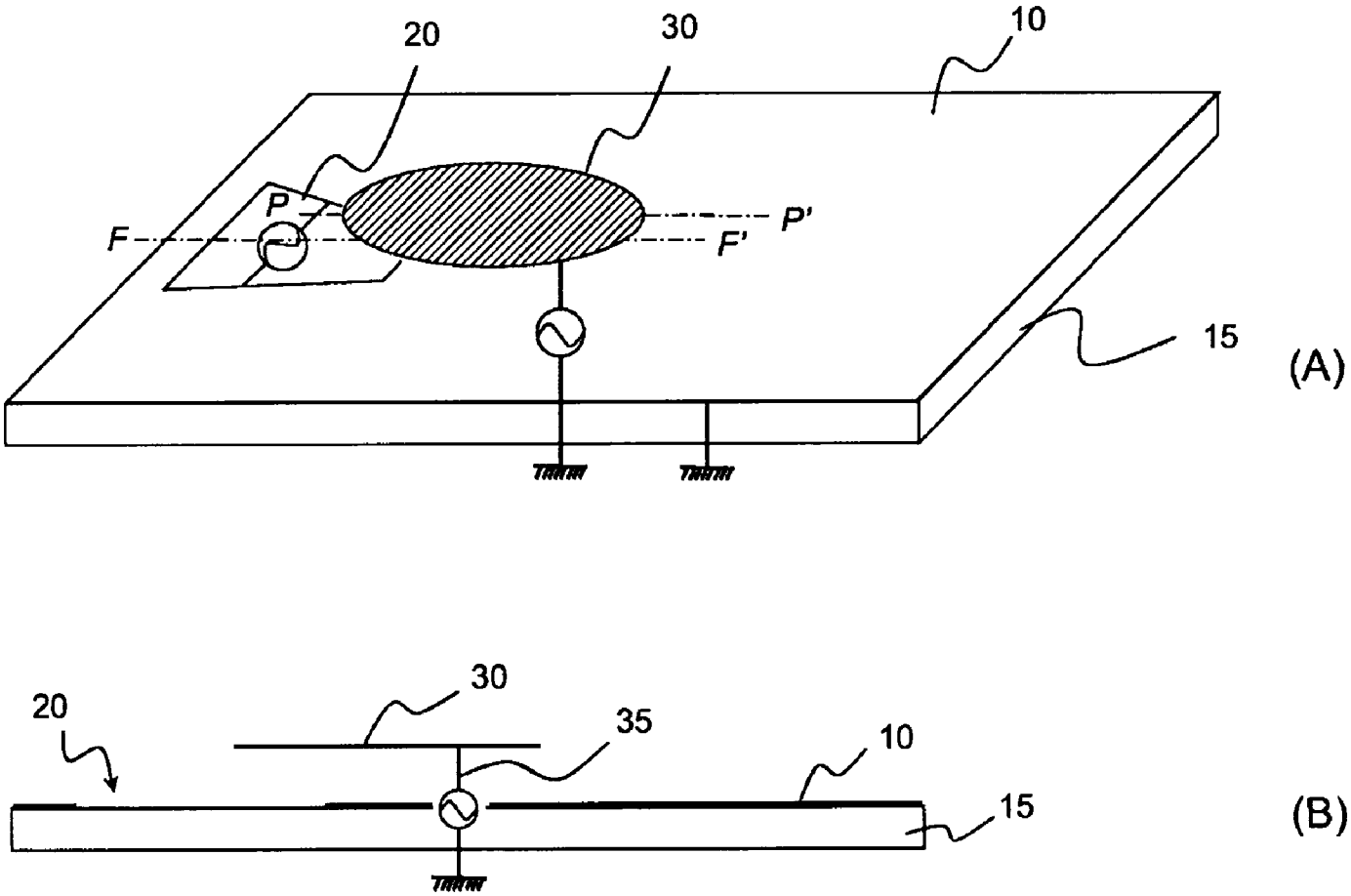

FIG. 1 schematically illustrates a first embodiment of the multi-antenna system according to the invention. A perspective view is illustrated in (A) and a vertical sectional view of the system in its middle plane is illustrated in (B). The latter comprises a metal ground plane 10 common to the patch type antenna and to the slot type antenna. The ground plane is typically made with a metal plate or with a metal layer deposited on a dielectric substrate 15. A slot 20 is laid out in the ground plane and a metal patch 30 is positioned so as to be at least partly plumb with the slot. The patch may be made either with a metal plate or with deposition of metal layer(s) on a dielectric substrate. The latter may be the same as that of the ground plane. In this case, the patch is deposited on the face of the substrate opposite to the one on which the ground plane is deposited.

Preferentially, the slot has a trapezoidal shape elongated along a longitudinal direction. It may however be of any symmetrical shape, for example rectangular or elliptical, or even non-symmetrical. Also, the metal patch 30 has an elongated elliptical shape along a longitudinal direction. It may however be of any symmetrical shape, for example rectangular or trapezoidal, or even non-symmetrical.

The directions of resonance of the slot and of the patch are denoted FF' and PP' respectively. As this was seen above, both of these axes are selected to be substantially parallel. These axes coincide here with the longitudinal axes of symmetry of the slot and of the patch, respectively.

The axes FF' and PP' may be shifted sideways with respect to each other in a plane parallel to the ground plane, or else contained in a same plane orthogonal to the ground plane, in which case the orthogonal projection of the axis PP' on the ground plane advantageously coincides with the FF' axis. In FIG. 1, both axes FF' and PP' belong to the middle plane of the system, orthogonal to the ground plane.

The electric field generated by the slot type antenna has rectilinear polarization orthogonal to the middle plane. On the other hand the electric field generated by the patch type antenna has rectilinear polarization parallel to the PP' axis. Reciprocally, the signal received by the slot type antenna is maximum when the electric field has rectilinear polarization orthogonal to the middle plane and the signal received by the patch type antenna is maximum when the electric field has polarization parallel to the PP' axis.

Given that the patch being at least partly plumb with the slot, the orthogonal projection of the patch on the metal plane has a non-empty intersection with the latter. According to an alternative embodiment, the orthogonal projection of the patch on the ground plane entirely includes the shape of the slot. The slot type and patch type antennas are thereby co-localized and the multi-antenna system is particularly compact.

The slot type antenna may be excited by means of a coaxial cable or a coplanar line in a way known to the one skilled in the art. Alternatively, the slot may be excited by coupling with a microstrip line printed on the substrate on the side opposite to the ground plane.

The patch type antenna may be excited by means of a metal probe 35 as illustrated in FIG. 1 or a coaxial cable, the core of which is connected to a point of the patch, the ground being connected to the ground plane. Alternatively, the patch may be excited by coupling with a microstrip line printed on the face of the substrate optionally dedicated to excitation.

More generally, the patch type and slot type antennas may be excited by direct electric contact and/or by electromagnetic coupling.

The length of the slot along the FF' axis is selected to be substantially equal to an integer multiple of half the guided wavelength, associated with the operating frequency. Also, the length of the patch along the PP' axis is selected to be substantially equal to an integer multiple of the half of the guided wavelength, associated with the operating frequency. It is recalled that the guided wavelength slightly differs from the free propagation wavelength because of the presence of edge fields. It is equal to twice the fundamental resonance length in the guide. An analytic expression of the guided wavelength for a slot antenna will for example be found in the article of R. Garg et al. entitled <<*Expressions for wavelength and impedance of a slotline*>> published in the IEEE Trans. on Microwave Theory, August 1976, page 532. Also, the guided wavelength $\lambda_g$ in a patch may generally be approximated by $\lambda_g \approx 0.982$ where $\lambda$ is the free propagation wavelength in the constitutive medium of the guide (either air or dielectric).

The operating frequencies of the slot and patch antennas are advantageously selected to be identical. More generally, as this will be seen later on, it is possible to use the slot antenna and the patch antenna in a same band of operating frequencies without any significant coupling between both antennas. Typically, for a system intended to be used in a UMTS (Universal Mobile Telecommunication System) terminal, the operating frequency will be of the order of 2 GHz and the slot and patch lengths of the order of 6 to 7.5 cm. These lengths are compatible with the dimensions of a mobile terminal.

Figure 2:
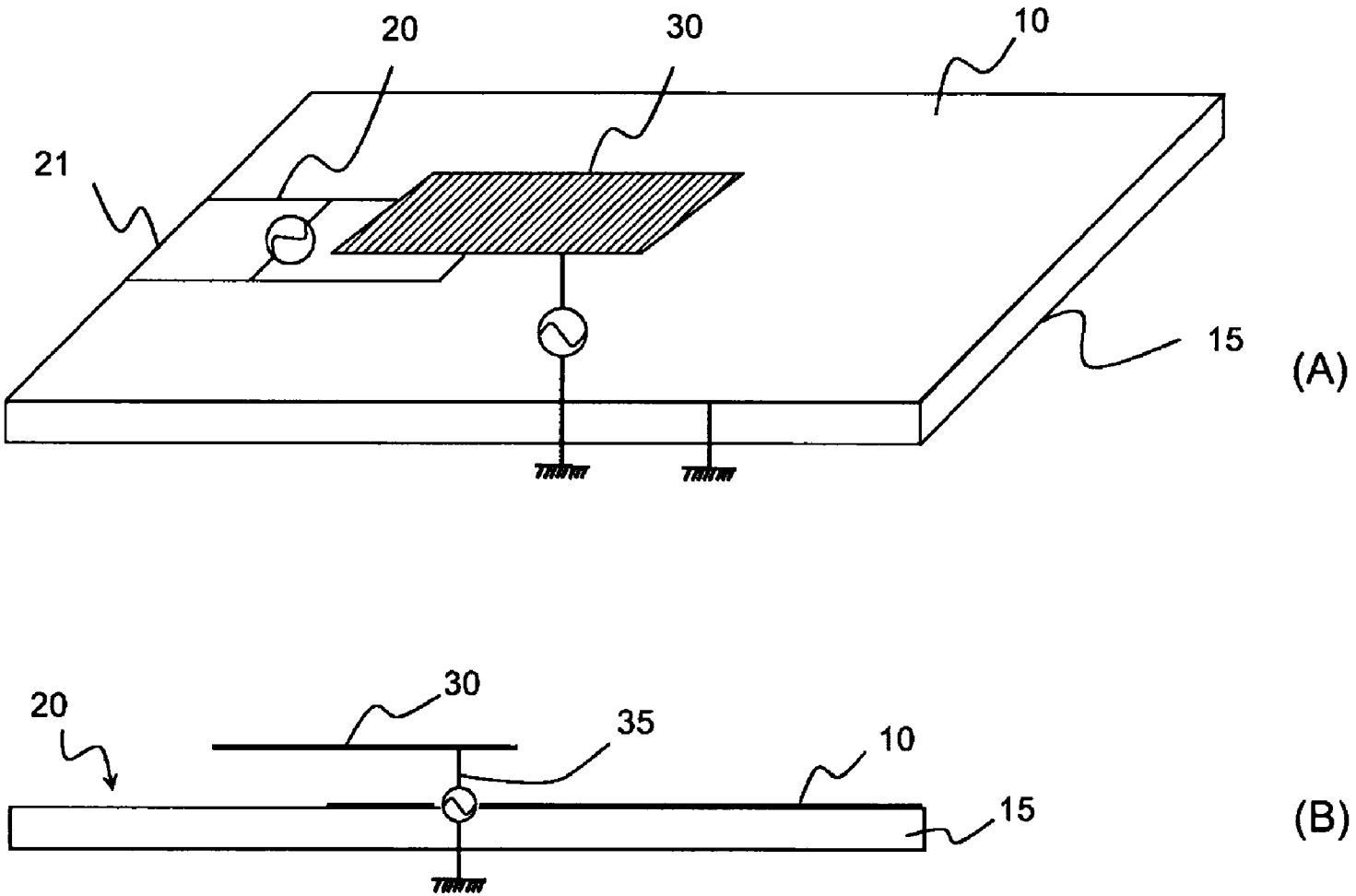

In order to further reduce the dimensions of the system, it is proposed according to a second embodiment, to use half a slot instead of an entire slot. More specifically, the slot is open on one side 21 over the whole of its width. This embodiment is illustrated in FIG. 2. In this figure, it is assumed for the purposes of illustration that the entire slot was a rectangle and that the patch 30 was also rectangular, but other shapes may be contemplated, as indicated earlier. The half-slot 20 appears as a notch at the periphery of the ground plane 10. The length of the notch along the FF' axis is equal to an integer multiple of the quarter of the guided wavelength at the operating frequency.

Figure 3:
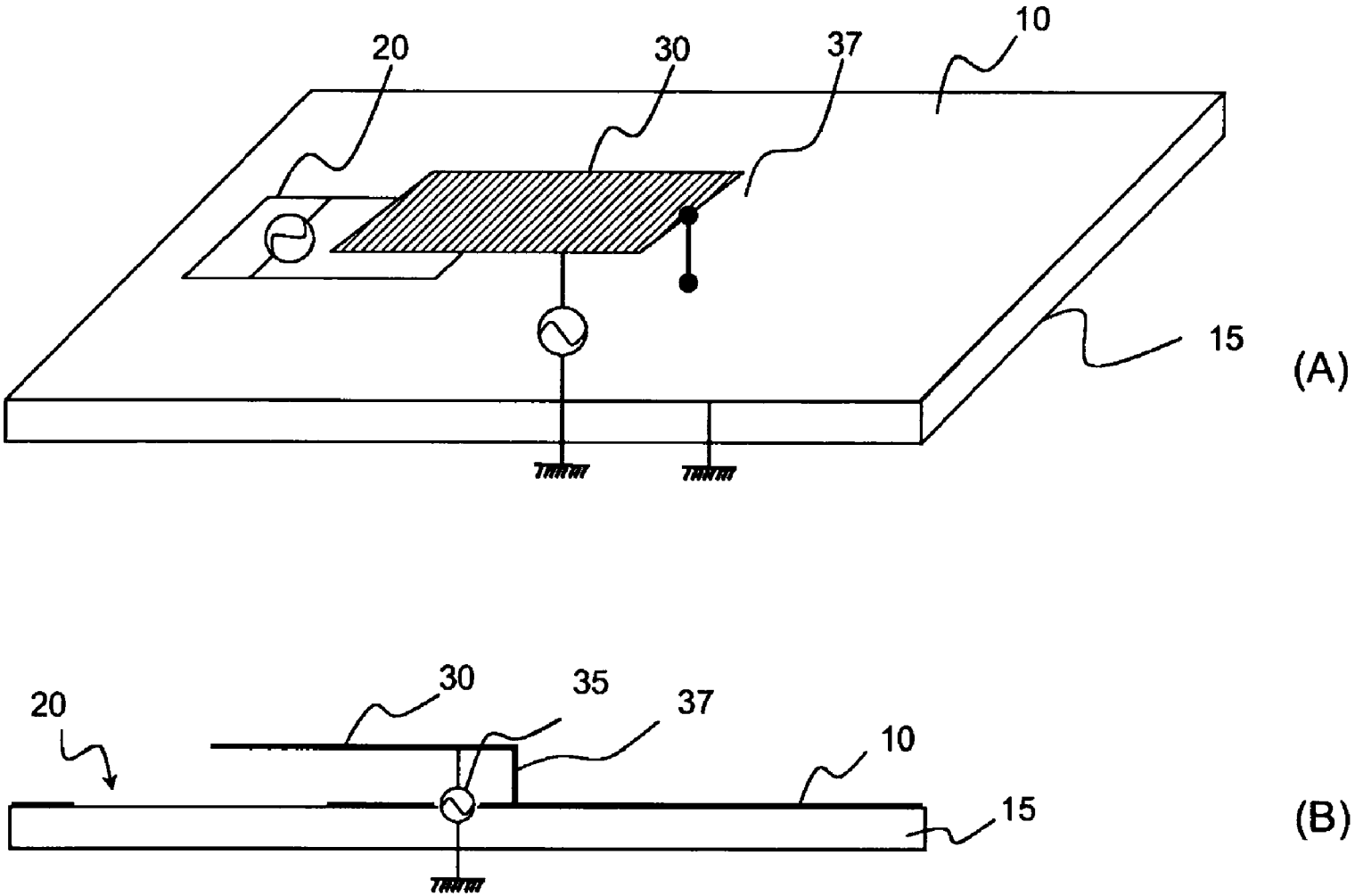

It is also possible to reduce the length of the patch in the PP' direction as indicated in FIG. 3, according to a third embodiment of the multi-antenna system according to the invention. In this embodiment, a metal return 37 towards the ground plane is provided at the edge of the patch. This metal return may be a wire or, as in the embodiment illustrated in FIG. 4, made by means of a metal plate 37 substantially orthogonal to the ground plane. This plate then achieves the electrical junction between the edge of the patch, orthogonal to the longitudinal axis PPP', located on the side opposite to the slot, with the ground plane. The length of the patch along the PP' axis is then advantageously selected to be equal to an integer multiple of the quarter of the guided wavelength (in the patch), associated with the operating frequency. The slot 20 remains with a length equal to an integer multiple of half the guided wavelength (in the slot) as in the first embodiment.

Figure 4:
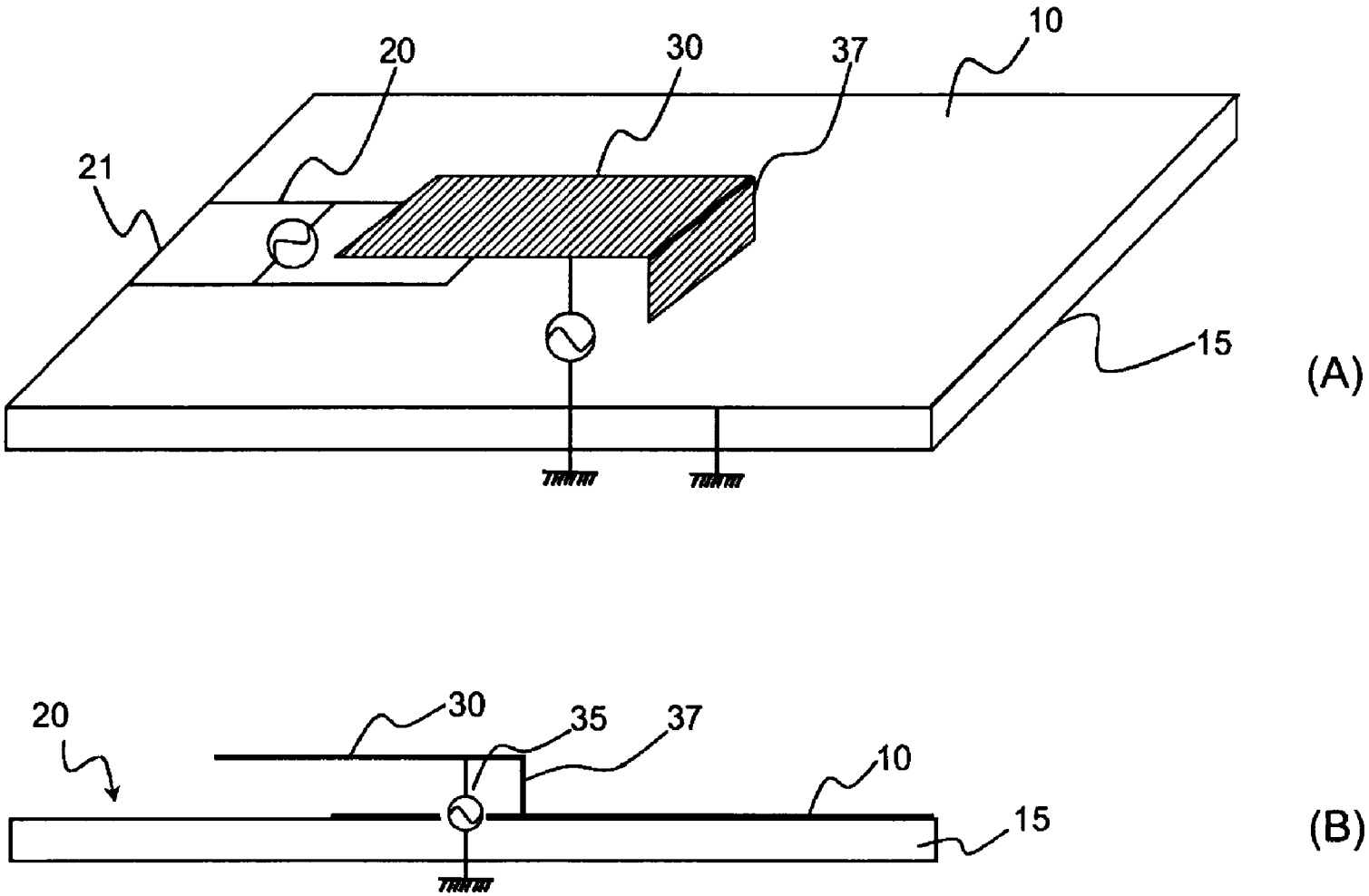

FIG. 4 schematically illustrates a fourth particularly advantageous embodiment of the multi-antenna system according to the invention. In this embodiment, the slot 20 and the patch 30 have respective lengths substantially equal to integer multiples of the quarter of the guided wavelength (in the slot and in the patch, respectively), associated with the operating frequency. The slot opens out at the periphery of the ground plane as in the second embodiment and a metal return 37 is provided as a plate at the edge of the patch, as already described. Of course, the metal return may be a wire, as illustrated in FIG. 3. Typically, for a system intended to be used in a UMTS terminal, the slot and patch lengths will be of the order of 3 cm and the height of the plate 37 acting as a return to the ground, is of the order 1 cm.

In order to still further reduce the dimensions of the aforementioned antennas, working at even smaller fractions of the guided wavelength ($\lambda_g/8$, $\lambda_g/10$, . . . ) and/or using materials with higher dielectric constants, allowing a reduction of $\lambda_g$ and/or a loading of the antennas with discrete or distributed components (capacitors, inductors, . . . ) as known to one skilled in the art, may be contemplated.

In the second, third and fourth embodiments, excitation of the slot and of the patch may be achieved according to the same alternatives as discussed for the first embodiment.

Figure 5:
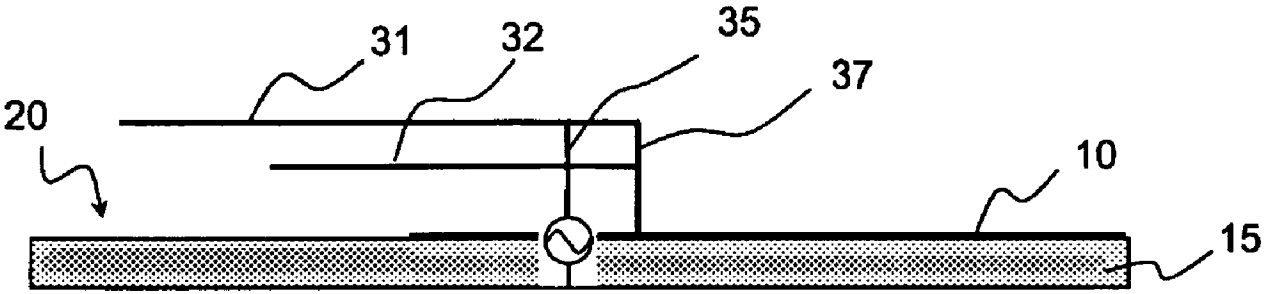

FIG. 5 schematically illustrates the sectional view of a multi-antenna system according to a fifth embodiment of the invention, in which provision is made for a plurality of patch antennas 31, 32 with different lengths being plumb with the slot. The return to the ground 37 is advantageously common but distinct ground returns may be also be contemplated. The ground return may be a wire or of the plate type as already seen above. In the same way, the excitation probe 35 is advantageously common to the different patch antennas but distinct probes may also be contemplated. The superposed patches correspond to the same resonance frequency. More specifically, the lengths of these patches are substantially equal to odd multiples of the quarter of the guided wavelength in these patches. As earlier, the operating frequency of the patches is the same as that of the half-slot antenna 20. The advantage of such an assembly is to obtain a particularly compact system with a high gain.

Figure 6:
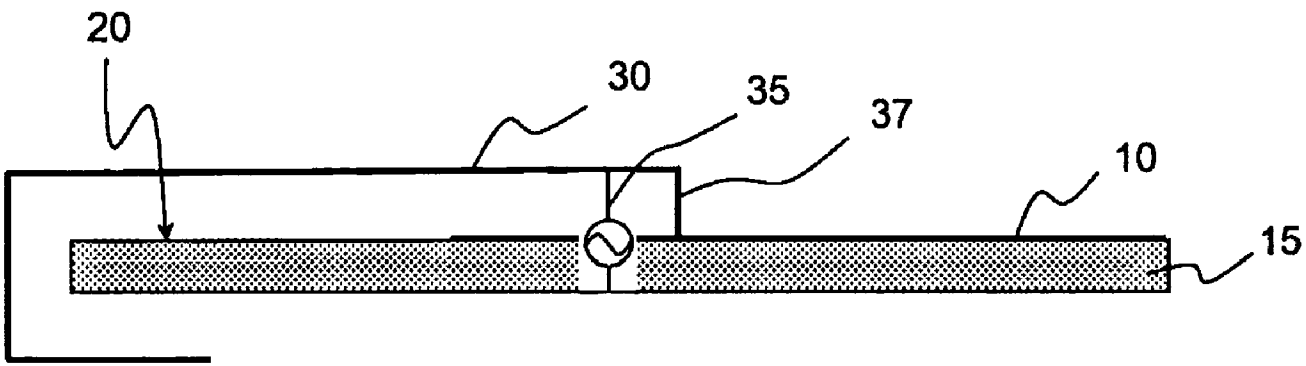

FIG. 6 schematically illustrates the sectional view of a multi-antenna system according to a sixth embodiment of the invention, in which the patch antenna 30 is folded back under the ground plane. The resonance frequency is defined by the total length of the <<unfolded>> patch. An arrangement which is more compact than those discussed earlier is thereby obtained. If necessary, several superposed patch antennas may be folded under the ground plane.

Figure 7:
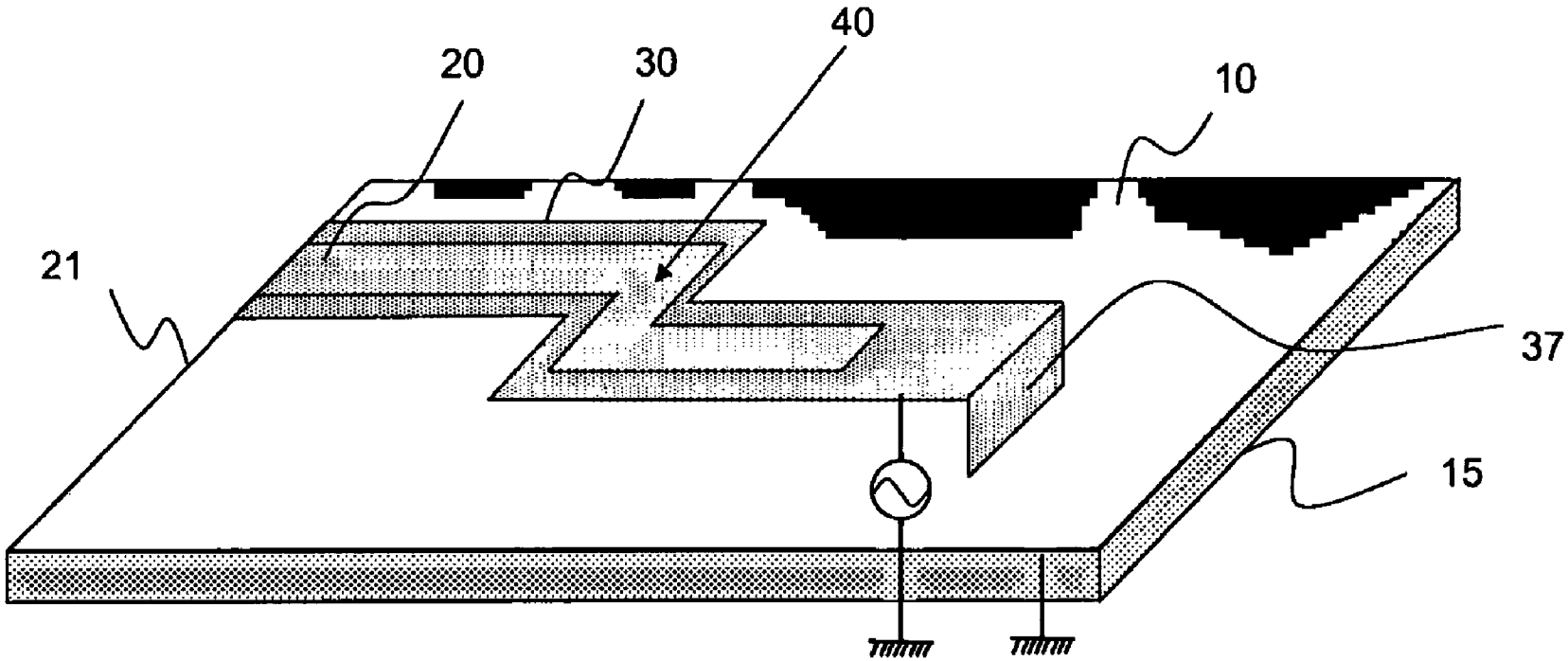

FIG. 7 schematically illustrates a multi-antenna system according to a seventh embodiment of the invention. In this embodiment, the slot antenna 20 as well as the patch antenna 30 which is plumb with it, although substantially elongated along a longitudinal direction, has a slight transverse shift at 40. By slight transverse shift is meant a shift by a substantially lower amplitude than the spatial extension of the system in the longitudinal direction. Each of both antennas comprises first and second portions, oriented along a same longitudinal direction, as well as an intermediate portion joining the first and second portions, oriented along a transverse direction. With the transverse shift of the patch and slot antennas, each of them may be receiving antennas according to two distinct polarization modes.

Figure 8:
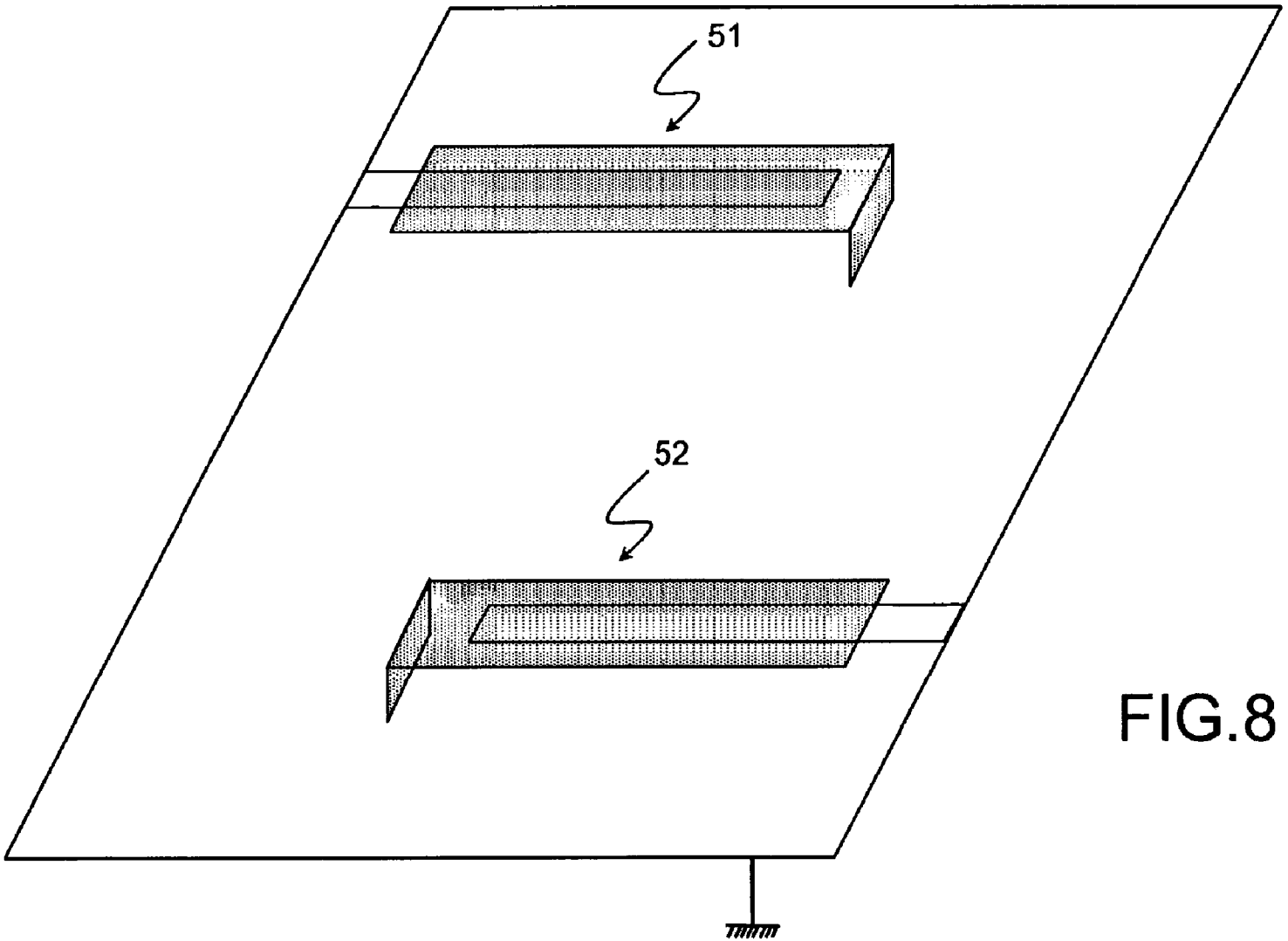
FIG. 8 illustrates a first exemplary arrangement of multi-antenna systems according to the invention on the ground plane of a mobile terminal.
Figure 9:
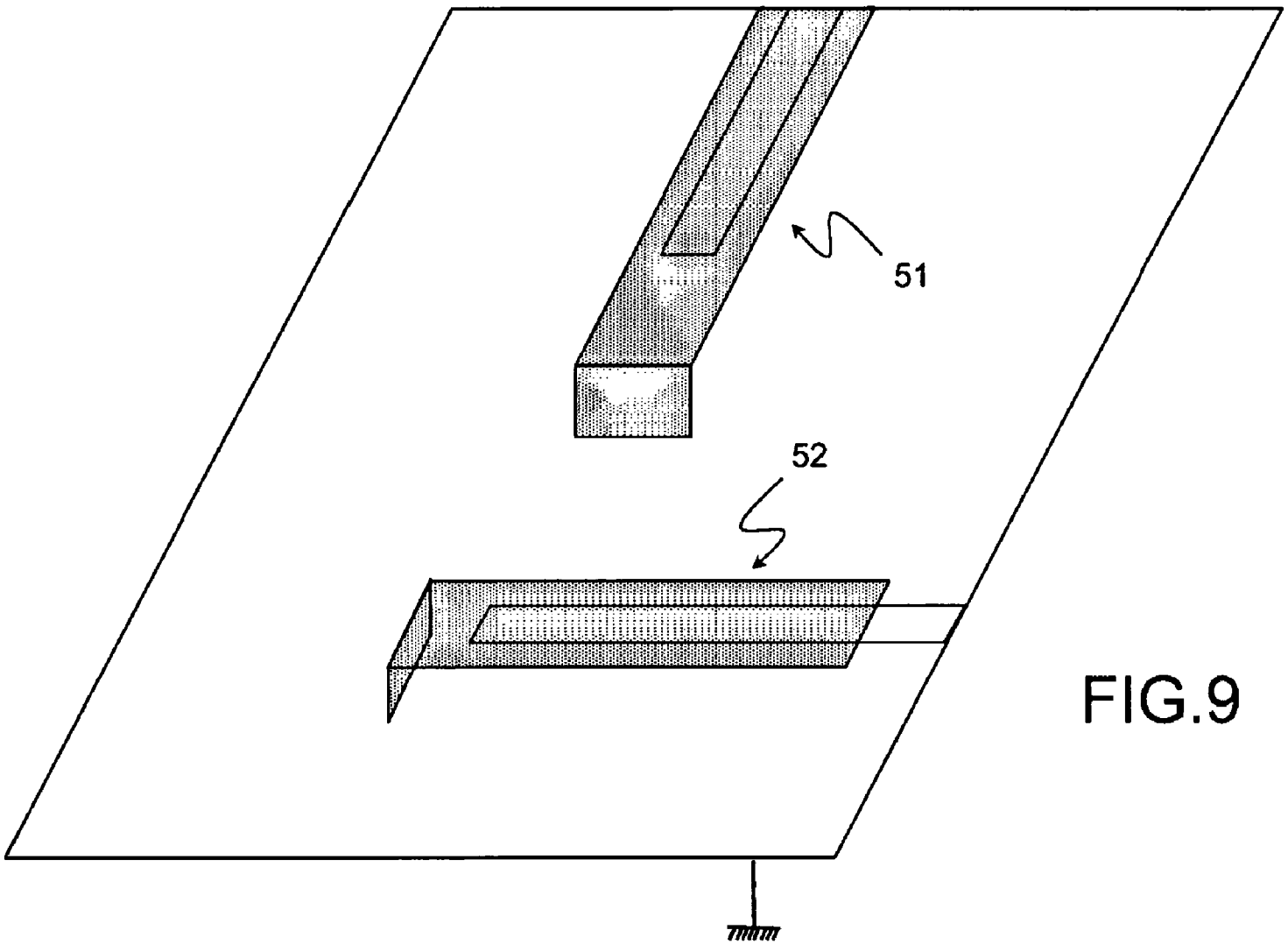
FIG. 9 illustrates a second exemplary arrangement of multi-antenna systems according to the invention on the ground plane of a mobile terminal.

The multi-antenna systems according to the invention may be combined in order to make up a composite system with higher gain and/or diversity order. In particular, FIGS. 8 and 9 show two exemplary arrangements of said multi-antenna systems on the ground plane of a mobile terminal. In the arrangement of FIG. 9, both multi-antenna systems 51 and 52 are positioned head-to-tail. The respective axes of established resonance of both antenna systems are substantially parallel. In FIG. 9, the directions of established resonance of both systems are selected to be substantially orthogonal. By using the systems 51 and 52 it is possible to obtain both spatial diversity due to the spacing between antennas, and polarization diversity.

Figure 10:
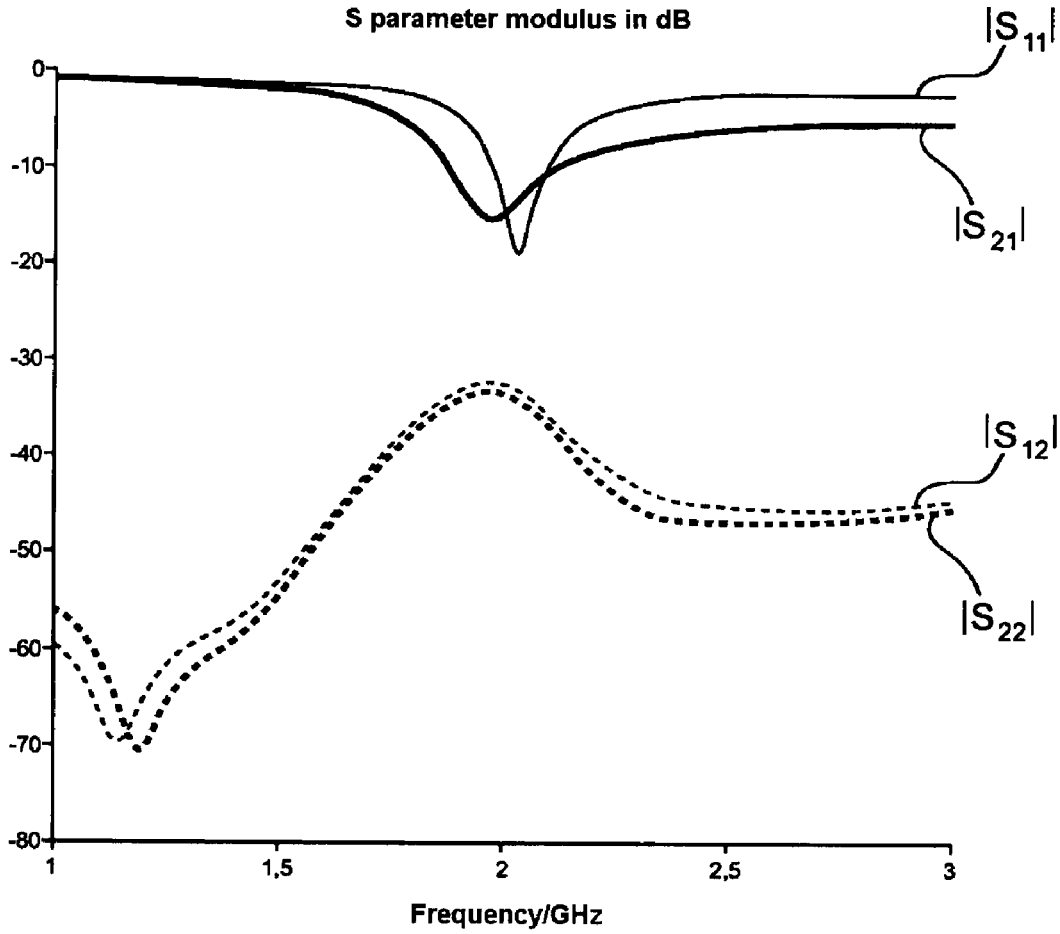
FIG. 10 illustrates the reflection and coupling coefficients versus the operating frequency of a multi-antenna system according to the invention.

FIG. 10 gives the moduli of the coefficients of the matrix S versus the operating frequency for a multi-antenna system according to the fourth embodiment of the invention with a quarter wave patch and slot. $|S_{11}|$ and $|S_{22}|$ respectively represent the proportion of reflected energy on the input port of the antenna 1 (slot type antenna) and on the input port of the antenna 2 (patch type antenna), in other words the reflection coefficients on these input ports, expressed in dB. $|S_{12}|$ and $|S_{21}|$ respectively represent the energy coupling of antenna 1 to antenna 2 and of antenna 2 to antenna 1.

It is seen that in a frequency range around 2 GHz, the reflection coefficients $|S_{11}|$ and $|S_{22}|$ are both less than −10 dB, which expresses proper impedance matching of the system in a common frequency band. Additionally in this same frequency band, the coupling coefficients $|S_{12}|$ and $|S_{21}|$ are below −30 dB. With the low coupling level between both antennas, the polarization diversity may be utilized at best.

Figure 11:
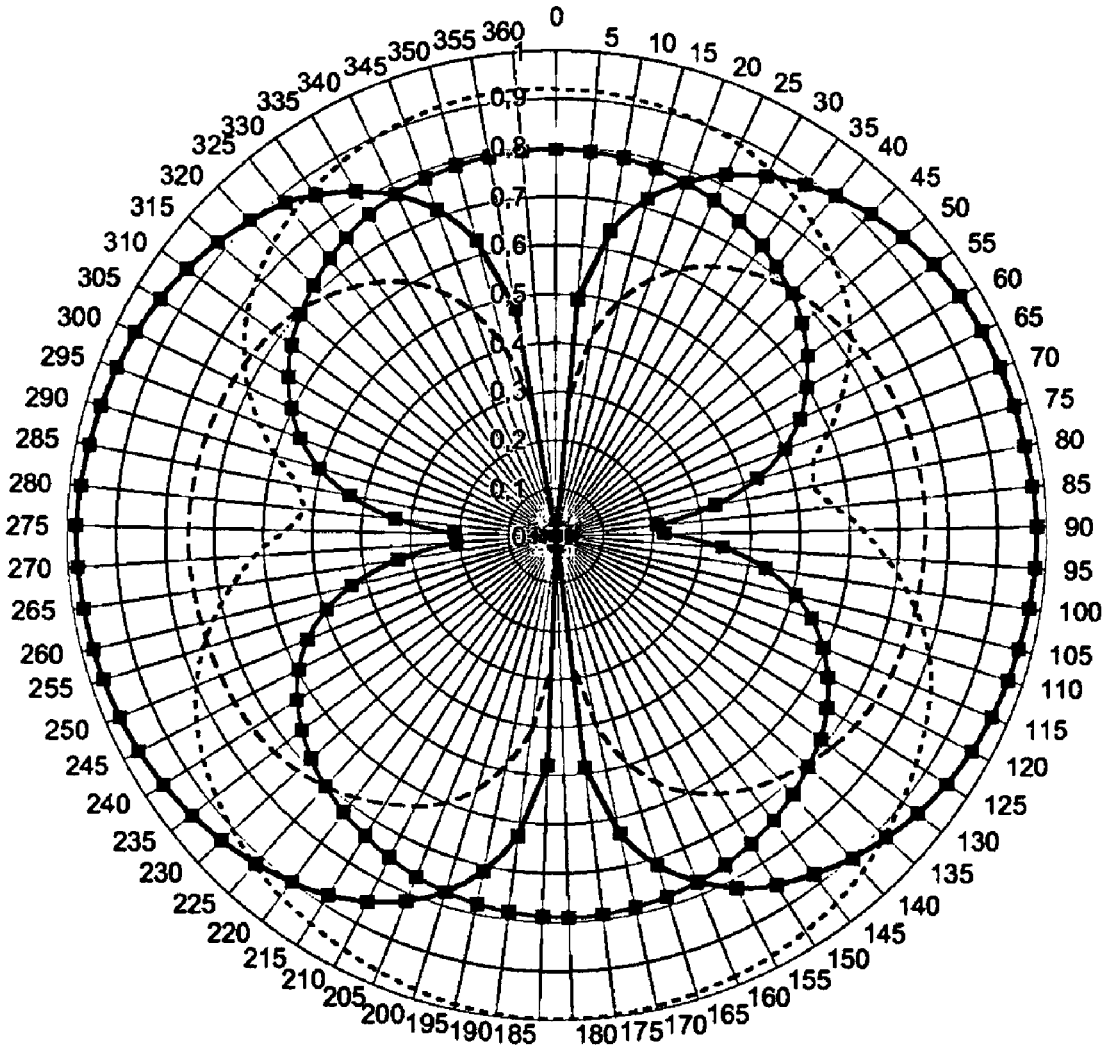
FIG. 11 illustrates the directivity diagrams versus the polarization of the constitutive antennas of a multi-antenna system according to the invention.

FIG. 11 shows the directivity diagrams of the slot type antenna and of the patch type antenna for a vertically polarized electric field and a horizontally polarized electric field, in a sectional plane parallel to the ground plane and equidistant between the latter and the plane containing the metal patch 30. It is noted that for a given polarization of the electric field, the maximum of the directivity diagram of an antenna corresponds to the minimum of the directivity diagram of the other one.

The invention claimed is:

1. A polarization diversity multi-antenna system comprising a first slot type antenna (20) and at least one second patch type antenna (30), said first and second antennas sharing the same ground plane (10), the slot of the first antenna being laid out in said ground plane and the patch of the second antenna being at least partly plumb with said slot, said first and second antennas having a common operating frequency band, characterized in that:

said slot is open on one side over its width and its length is substantially equal to an odd multiple of the quarter of the guided wavelength of the slot, in said operating frequency band and/or the patch is electrically connected to the ground plane and its length is substantially equal to an odd multiple of the quarter of the guided wavelength in the patch, in said operating frequency band.

2. The multi-antenna system according to claim 1, characterized in that said first and second antennas have substantially parallel directions of established resonance.

3. The multi-antenna system according to claim 2, characterized in that the patch has a first elongated shape along a first axis of symmetry, in that the slot has a second elongated shape along a second axis of symmetry, and in that said first and second axes of symmetry are substantially parallel.

4. The multi-antenna system according to any of the preceding claims, characterized in that said antennas are excited by direct electric contact and/or electromagnetic coupling.

5. The multi-antenna system according to claim 1, characterized in that it comprises a plurality of second antennas of the patch type having a common operating frequency band with the first antenna, the patches being electrically connected to the ground plane and having lengths substantially equal to odd multiples of the quarter of the guided wavelength in these patches, in said operating frequency band.

6. The multi-antenna system according to claim 5, characterized in that said first antenna and said second antennas have substantially parallel directions of established resonance.

7. The multi-antenna system according to claim 1 or 2, characterized in that said slot is open on one side, that the second antenna is entirely plumb therewith and extends at one of its ends beyond said side of said slot, said end of the second antenna being folded under said ground plane.

8. The multi-antenna system according to claim 1 or 2, characterized in that said first and second antennas respectively have first and second shapes substantially elongated along a longitudinal axis, said first and second shapes having along this axis a slight shift along a transverse direction.

9. A mobile terminal comprising a ground plane and at least two multi-antenna systems according to the preceding claims, said multi-antenna systems extending along two parallel axes and being positioned head-to-tail on said ground plane.

10. A mobile terminal comprising a ground plane and at least two multi-antenna systems according to the preceding claims, said multi-antenna systems extending along two orthogonal axes on said ground plane.

* * * * *